US006305496B1

(12) United States Patent
Bieszczad

(10) Patent No.: US 6,305,496 B1
(45) Date of Patent: Oct. 23, 2001

(54) SAFETY MOBILE LADDER STAND

(75) Inventor: Todd Anthony Bieszczad, St. Clair, MI (US)

(73) Assignee: Material Control, Inc., Croswel, MI (US)

( * ) Notice: Subject to any disclaimer, the term of this patent is extended or adjusted under 35 U.S.C. 154(b) by 0 days.

(21) Appl. No.: 09/519,114

(22) Filed: Mar. 6, 2000

(51) Int. Cl.[7] ..... E04G 3/16

(52) U.S. Cl. ..... 182/15; 182/17; 182/127; 280/47-16

(58) Field of Search ..... 182/12, 13, 14, 182/15, 16, 17, 103, 127, 180; 280/47.16

(56) References Cited

U.S. PATENT DOCUMENTS

| | | | | |
|---|---|---|---|---|
| 3,130,814 | | 4/1964 | Del Aquila . | |
| 3,155,190 | | 11/1964 | Borgman . | |
| 3,291,254 | | 12/1966 | Mihalik . | |
| 3,684,055 | | 8/1972 | Rice . | |
| 3,870,333 | * | 3/1975 | Burdick et al. | 280/47.16 X |
| 4,063,616 | | 12/1977 | Gutierrez . | |
| 4,442,919 | | 4/1984 | Fulcher . | |
| 5,556,118 | * | 9/1996 | Kern et al. | 280/47.16 X |
| 5,791,434 | * | 8/1998 | Swiderski | 182/17 |
| 5,941,341 | | 8/1999 | Gillis et al. . | |
| 6,039,147 | * | 3/2000 | Gillis et al. | 182/15 |
| 6,179,087 | * | 1/2001 | Moffat | 182/15 |

FOREIGN PATENT DOCUMENTS

| | | |
|---|---|---|
| 1021831 | 11/1977 | (CA) . |
| 791282 | 1/1956 | (GB) . |

OTHER PUBLICATIONS

Cotterman Rolling Metal Ladders, Bulletin CL–328; Cotterman Co., P. O. Box 168, 130 Seltzer Road, Croswell, MI 48422.

* cited by examiner

*Primary Examiner*—Bruce A. Lev
(74) *Attorney, Agent, or Firm*—Dykema Gossett PLLC

(57) ABSTRACT

The ladder stand employs a pair of swivable caster wheels at the front and a pair at the rear which are used in cooperation with a pair of closely located non-swivable caster wheels, thereby providing a structure which has three modes of operation, one mode for climbing, a second mode which permits the stand to be pushed in a straight line with wide turns and a third mode of operation which permits the stand to be first pushed laterally and to provide sharp turns. A front wheel support is mounted on the front end and a retractable first pair of swivable caster wheels is mounted on the front support. A rear wheel support is mounted on the rear end, with a retractable second pair of swivable caster wheels mounted on the rear support. A third pair of non-swivable rigid caster wheels are mounted at the rear end.

11 Claims, 8 Drawing Sheets

SAFETY MOBILE LADDER STAND

BACKGROUND OF THE INFORMATION

1. Field of the Invention

The present invention relates to a safety mobile ladder stand and more particularly, to a large ladder stand which can be used in small spaces where mobility of a larger ladder stand is restricted.

2. Description of the Prior Art

Mobile or safety ladder stands are generally known in the industry and are used by workers and persons who need to reach products or materials stored on shelves in stores and warehouses. Such safety ladder stands also generally incorporate a rolling/locking mechanism so that the ladder stand can be moved easily to different locations in the warehouse or building when such a mechanism is actuated. With such a construction, the rolling/locking mechanism is deactivated when the mobile ladder stand is to be used such as when a person climbs on it to reach overhead shelves or spaces. The deactivation of the rolling/locking mechanism stabilizes the ladder stand in a fixed position thereby allowing for a safer and steadier use of the stand.

Some large mobile ladder stands with rolling/locking mechanisms are difficult or awkward to maneuver in small spaces such as in the aisleways of stores or warehouses. This is due to the fact that the length of the base must be increased to accommodate a taller ladder stand. Since such ladder stands are generally supported by wheel sets at all four corners of the base, a longer base makes turning of the stand difficult.

The problem stated previously was addressed in part in U.S. Pat. No. 5,941,341 entitled "Mobile Ladder Stand" which issued on Aug. 24, 1999. This patent discloses a safety ladder stand having a generally rectangular base having a front and rear and a center beam, with a plurality of stair treads extending upwards from the front of the base and means for supporting the stair treads secured to the base. Front wheels are mounted at the front of the base and beneath the top of the stair treads, with center wheels mounted on the center beam of the base and rear wheels mounted at the rear of the base. A set of feet are mounted at the front of the base. The ladder stand has an activated position and a deactivated position. In the activated position, the front and center wheel sets are in contact with the ground to enable the ladder stand to roll and the rear wheels and front support feet are out of contact with the ground. In the deactivated position of the ladder stand, the front and center wheel sets are not in contact with the ground and the rear wheels and the front wheels are in contact with the ground to prevent the ladder stand from being rolled. It includes means for moving the ladder stand from the deactivated position to the activated position.

The assignee of the present invention has manufactured for many years relatively small ladder stands with five to nine steps which are provided with a base having wheel supports at the front and rear of the stand. Each wheel support is provided with a safe-lock mechanism and a pair of swivable casters or wheels rotatable throughout 360°. The use of the safe-lock mechanism and swivable caster wheels at the rear end of the base allows the ladder stand to be more readily maneuverable in confined spaces.

The assignee of the present invention has also manufactured for many years relatively large ladder stands with six to nineteen steps, as an example, having a base with a safety lock mechanism and a pair of swivable caster wheels at the front and a pair of rigid caster wheels at the rear of the base. It is difficult with such a construction to maneuver the large ladder stands in confined spaces.

While a great variety of mobile ladder stands have been heretofore been proposed, nevertheless there remains a need for improved relatively large mobile ladder stands which are simple in construction, are relatively inexpensive to manufacturer and are convenient to use.

SUMMARY OF THE INVENTION

It is a feature of the present invention to provide an improved relatively large ladder stand which is stable when the ladder stand is in use and is mobile when it is required to move the ladder stand in confined spaces or areas.

It is a further feature of the present invention to provide an improved relatively large mobile ladder stand which employs a pair of swivable caster wheels at the front of the ladder and a pair of swivable caster wheels at the rear of the ladder which are used in cooperation with a pair of closely located non-swivable caster wheels, thereby providing a structure which has three modes of operation, one mode for climbing, a second mode which permits the ladder to be pushed in a straight line with wide turns and a third mode of operation which permits the ladder stand to be first pushed laterally and to provide sharp turns.

In the broader aspects of this invention, there is provided a ladder stand comprising a unitary base having a front end and a rear end, with a plurality of stair treads extending upwardly from the base and supported thereon. A front wheel support is mounted on and located approximate to the front end of the base and a retractable first pair of swivable caster wheels is mounted on the front wheel support. The ladder stand further has a rear wheel support mounted on and located inwardly from the rear end of the base, with a retractable second pair of swivable caster wheels mounted on the rear wheel support. A third pair of non-swivable rigid caster wheels are mounted at the rear end of the base outwardly from the retractable second pair of caster wheels. A plurality of foot pads are mounted on the front end of the base forward of the retractable first pair of swivable caster wheels.

A pair of laterally spaced apart independently operated foot pedals are mounted on the base at the front end thereof. Front and rear linkages are respectively carried by the front and rear wheel supports. A trip bar is located at the front end of the bottom stair tread. A trip tube is connected on one end to the front linkage and on the other end to the rear linkage. A reset tube is connected on one end to the front linkage and on the other end to the rear linkage. With such a construction, the trip bar of the present invention, when actuated, causes the trip tube to raise the front and rear wheel supports and the corresponding first and second pairs of swivable caster wheels from the ground thereby permitting the base to drop onto the foot pads at the front end and onto the rigid caster wheels at the rear end of the base thereby placing the ladder stand in a first mode of operation intended for a person climbing the ladder.

One of the pedals of the present invention, when actuated, causes the reset tube to lower the front wheel support and to bring the first pair of swivable caster wheels into contact with the ground thereby raising the front end of the base and the foot pads off the ground while maintaining the rigid caster wheels on the ground thereby placing the ladder stand in a second mode of operation intended for the ladder stand to be pushed to a new location either forward, backward or diagonally with straight tracking of the wheels.

The other of the pedals of the present invention, when actuated, lowers the rear wheel support and brings the second pair of swivable caster wheels into contact with the ground and raises the third pair of rigid caster wheels off the ground while maintaining the front caster wheels in contact with the ground thereby providing a third mode of operation intended for the ladder stand to be pushed or turned in confined spaces, with the four swivel caster wheels allowing for forward, backward, diagonal and lateral movement.

Other objects and distinctive features of the present invention which have not been referred to previously will appear from the following specification and claims and from the accompanying drawings wherein is shown a preferred embodiment of the present invention as described in the specification. The showing so made is not intended to be either exhaustive or as limiting the scope of the subject invention. The purpose here is to illustrate the invention so that others skilled in the art may so fully understand its principles and applications, that they may embody it and adapt it in any of various forms appropriate to the attainment of any particular or appropriate purpose in use.

DETAILED DESCRIPTION OF THE PREFERRED EMBODIMENT

Figure 1:
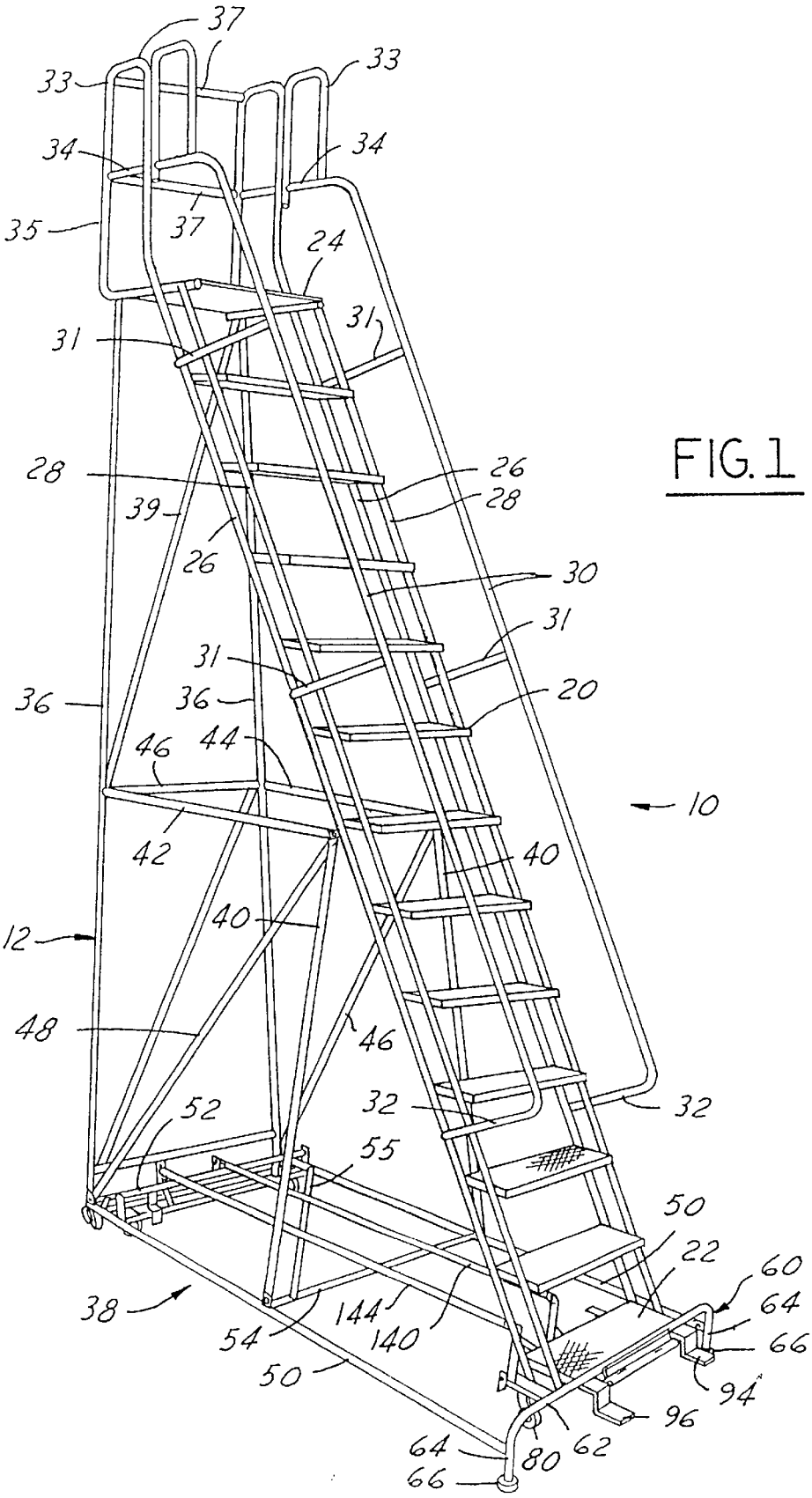
FIG. 1 is a perspective view of the ladder stand or apparatus in accordance with the present invention.

Referring now to the drawings, the present invention is shown embodied in a safety mobile ladder stand or assembly 10 comprising a rigid structural frame 12 for supporting a plurality of horizontal stair treads or steps 20 including the lower stair tread 22 and the top stair tread 24, with any number of intermediate treads or steps therebetween, as an example, from six to sixteen steps. The plurality of stair treads 20 are secured together at each of the sides thereof by a pair of straps 26 and 28. In order to protect the person climbing the stairs or treads 20, a pair of side hand rails 30 are provided. The hand rails 30 at the lower ends thereof are provided with inwardly turned extensions 32 which are connected to the inclined straps 26, 28. The upper ends of the hand rails 30 are provided with rearwardly turned rail portions 34 which form part of the safety rail enclosure 35 provided at the top of the ladder stand 10 above the top tread 24. The hand rails 30 are also connected to straps 26 and 28 by cross braces 31.

Figure 2:
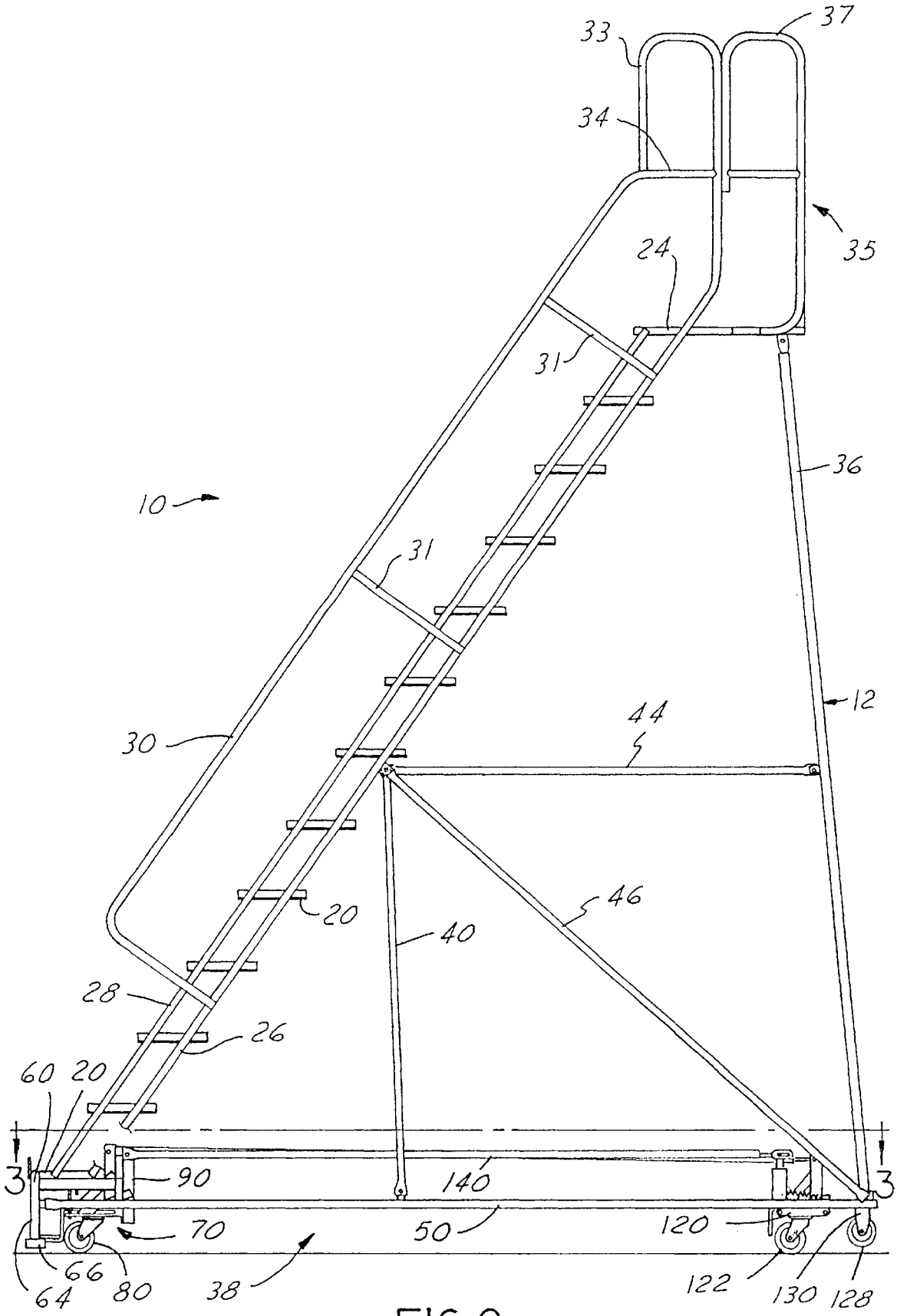
FIG. 2 is a side elevation of the safety ladder stand showing the first and second pair of swivable wheels in contact with the ground and further illustrating the third set of wheels and the foot pads spaced from the ground.
Figure 3:
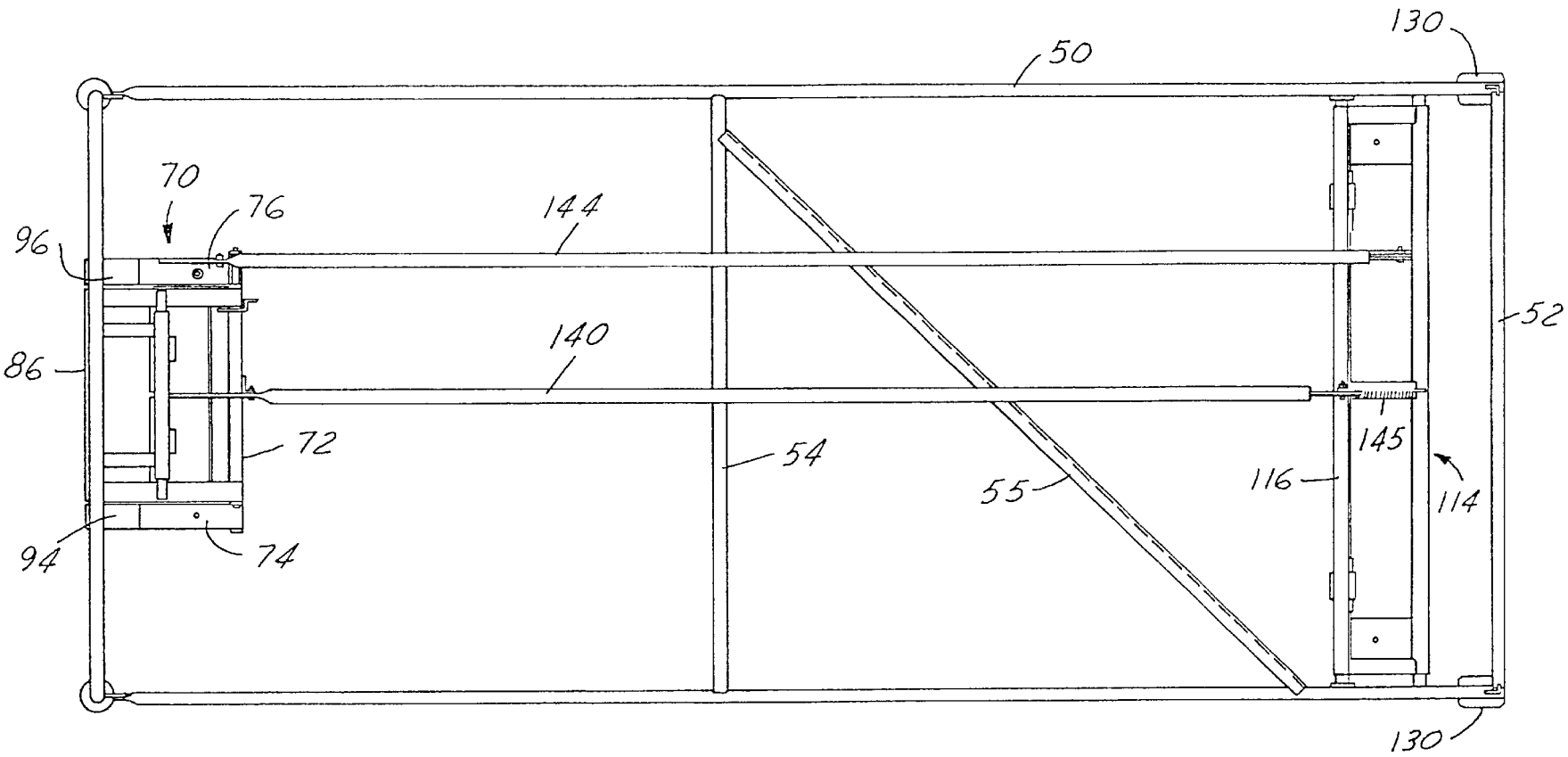
FIG. 3 is a top view of the base of the ladder stand looking in the direction of arrows 3—3 of FIG. 2.

The safety rail enclosure 35 is open at the front and includes the vertical rails 33 of varying heights which are interconnected by horizontal braces or struts 37 and the rail portions 34 as best illustrated in FIGS. 1 and 2. The safety rail enclosure 35 provides safety grips for a person when standing on the top tread or platform 24.

The frame 12 includes a pair of vertical support beams 36 at the rear thereof which extends from the base 38 to beneath the top tread 24. The upper part of the frame 12 at the rear thereof includes an upper diagonal member 39 which extends from the upper end of one rail 36 to an intermediate portion of the other rail 36 as best shown in FIG. 1. The frame 12 further includes a pair of front support members 40 which are arranged generally vertically, with the upper ends of each member 40 connected to a horizontal support structure consisting of horizontal framing members 42, 44 which are interconnected by a laterally extending member 46. The vertical members 40 are connected on the lower ends of the base 38 and the upper ends thereof are connected to the rear of the frame 12 by means of rearwardly and downwardly extending support members or braces 46 and 48. The cross members, beams and support elements forming the ladder stand 10 may be manufactured from steel or from 1 inch, 16 gauge aluminum tubing which is standard in the industry. The framing members are connected by bolts and nuts or by other means such as rivets or welding, well known in the art. It should be appreciated that the design of the stair treads and the arrangement of the support means and cross members are well known in the art and are not therefore critical to the practicing of the present invention.

The base 38 of the mobile ladder stand 10 includes a pair of longitudinally extending members 50 which are appropriately secured to laterally extending member 52 at the rear of the frame 12 and to the intermediate or center beam 54. The base also includes a brace 55 between center beam 54 and one of the longitudinally extending members 50.

The base 38 further includes at the front there of a laterally extending front support means 60 including a laterally extending element 62 attached to the tread 22 with the element 62 terminating in a pair of downwardly turned legs 64 which are provided with foot pads or bumpers 66. The longitudinal members 50 are secured to the legs 64 by suitable fasteners. The front support means 60 may also include a center leg and foot pad for larger ladder stands.

A front wheel support 70 is rotatably or movably mounted on and located adjacent or proximate to the front end of the base 38. The front wheel support 70 includes a frame 72 which includes bearing plates 74 and 76. The bearing plates 74, 76 provide support for the pair of front caster wheels 80 which are mounted in housings 82 and are rotatably carried by the bearing plates 74, 76 for rotation or swiveling throughout 360°. The construction of the caster wheels 80 and their respective housing are well known in the art.

The front wheel support 70 includes a safe-lock mechanism for rotatably raising and lowering the frame 72 to raise or lower the wheels 80 relative to the ground. Such mechanism includes a conventional trip bar 86 at the front of the lowest step or tread 22 which is coupled to the frame 72. The frame 72 is provided with a pair of upstanding first and second front linkages 88 and 90.

Figure 5:
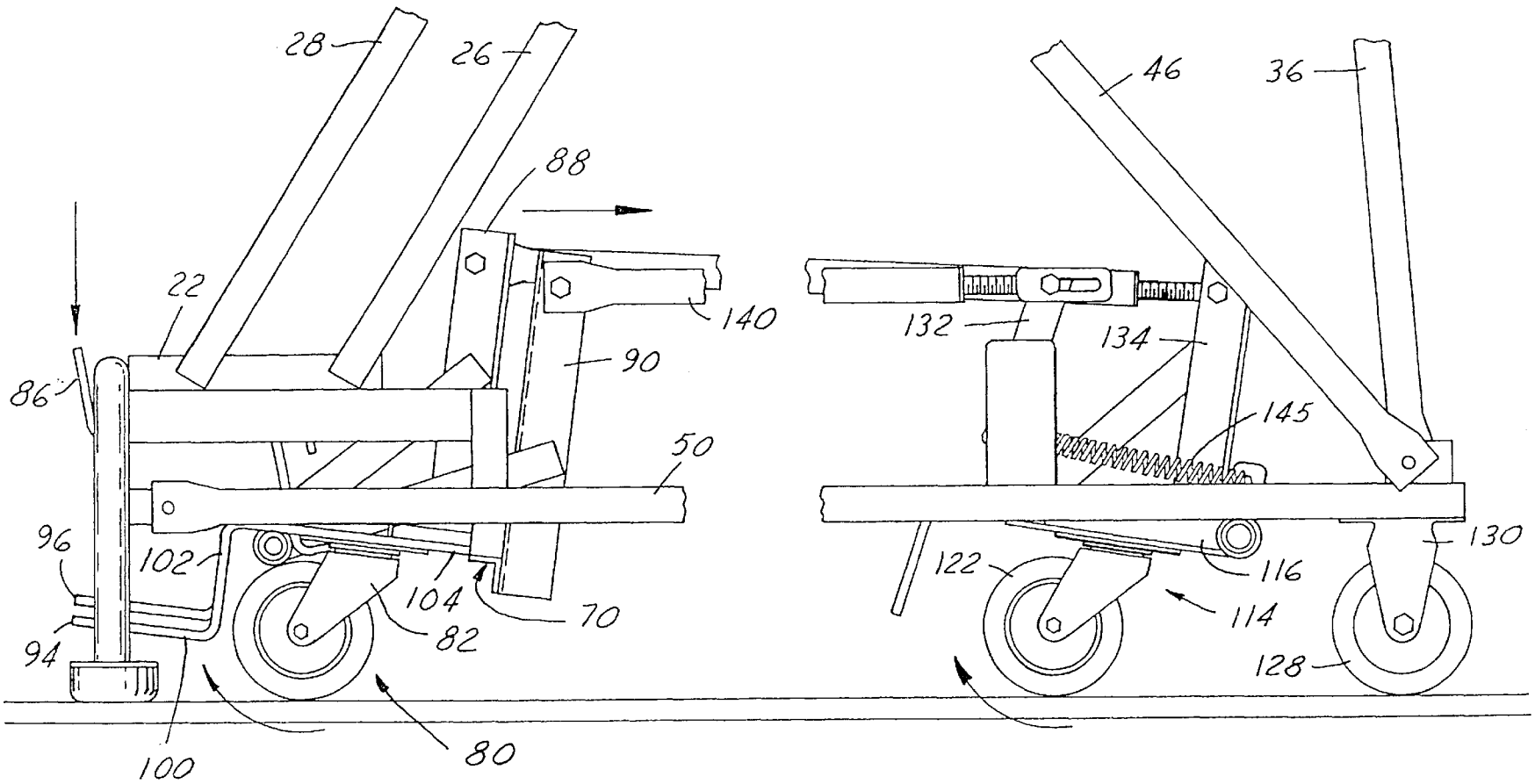
FIG. 5 is a fragmentary side elevational view, with parts broken away of the wheeled base, after the trip bar has been actuated so as to raise the first and second swivable wheels and to bring the legs or feet at the front of the base and the rigid wheels at the end of the base into contact with the ground as in the first mode of operation.

The front wheel support 70 also includes a left pedal 96 and a right pedal 94 as viewed in FIG. 1. Pedal 94 includes a foot portion 100, an upright portion 102 and a generally rectangular base portion 104 carried by the frame 72 as viewed in FIG. 5. Pedal 94 controls the front linkage 90 and the trip tube as will be subsequently described.

Figure 4:
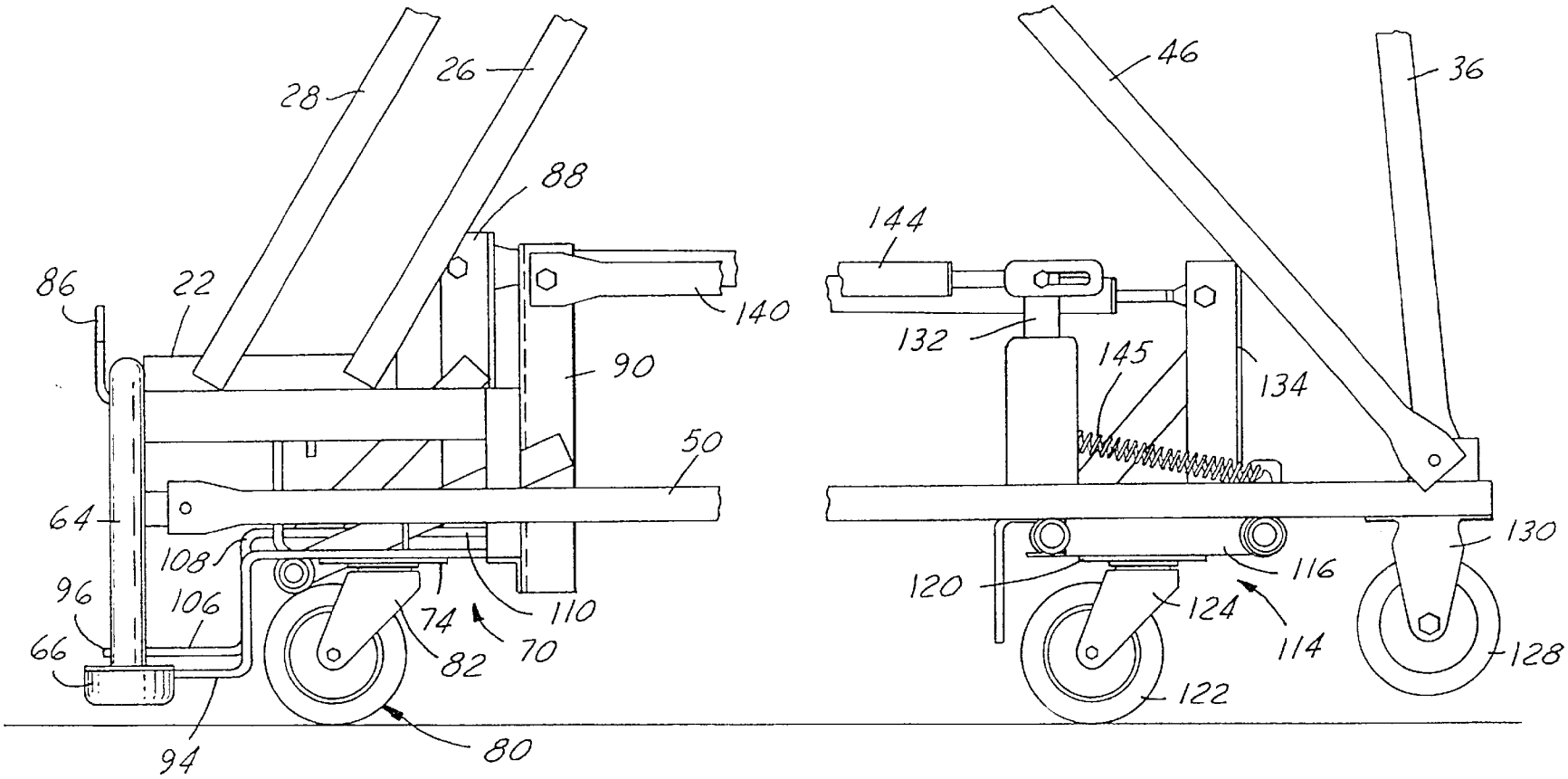
FIG. 4 is a fragmentary side elevational view of the wheel base of the ladder stand, with parts broken away and with the first and second swivable wheels in contact with the ground.

The left pedal 96, as shown in FIG. 4., includes a foot portion 106, an upright portion 108 and a generally rectangular base portion 110 carried by the frame 72. Pedal 96 controls the front linkage 88 and the reset tube as will be subsequently described.

A rear wheel support 114 is rotatably mounted on and located inwardly from the rear end of the base 38 as illustrated in FIG. 4. The rear wheel support 114 includes a frame 116 attached to the longitudinal members 50. The frame 116 includes a pair of horizontal bearing plates 120 which support a retractable second pair of swivable caster wheels mounted thereon. The second pair of swivable caster wheels 122 are each mounted in a housing 124 and are rotatably carried by the bearing plates 120 for rotation through 360°.

A third pair of non-swivable rigid caster wheels 128 are mounted on the rear end of the base 38. The rigid caster wheels 128 are mounted in housings 130 and are rotatable only and are not swivable. The wheels 128 are located close to but outwardly from the retractable second pair of swivable caster wheels 122.

Figure 6:
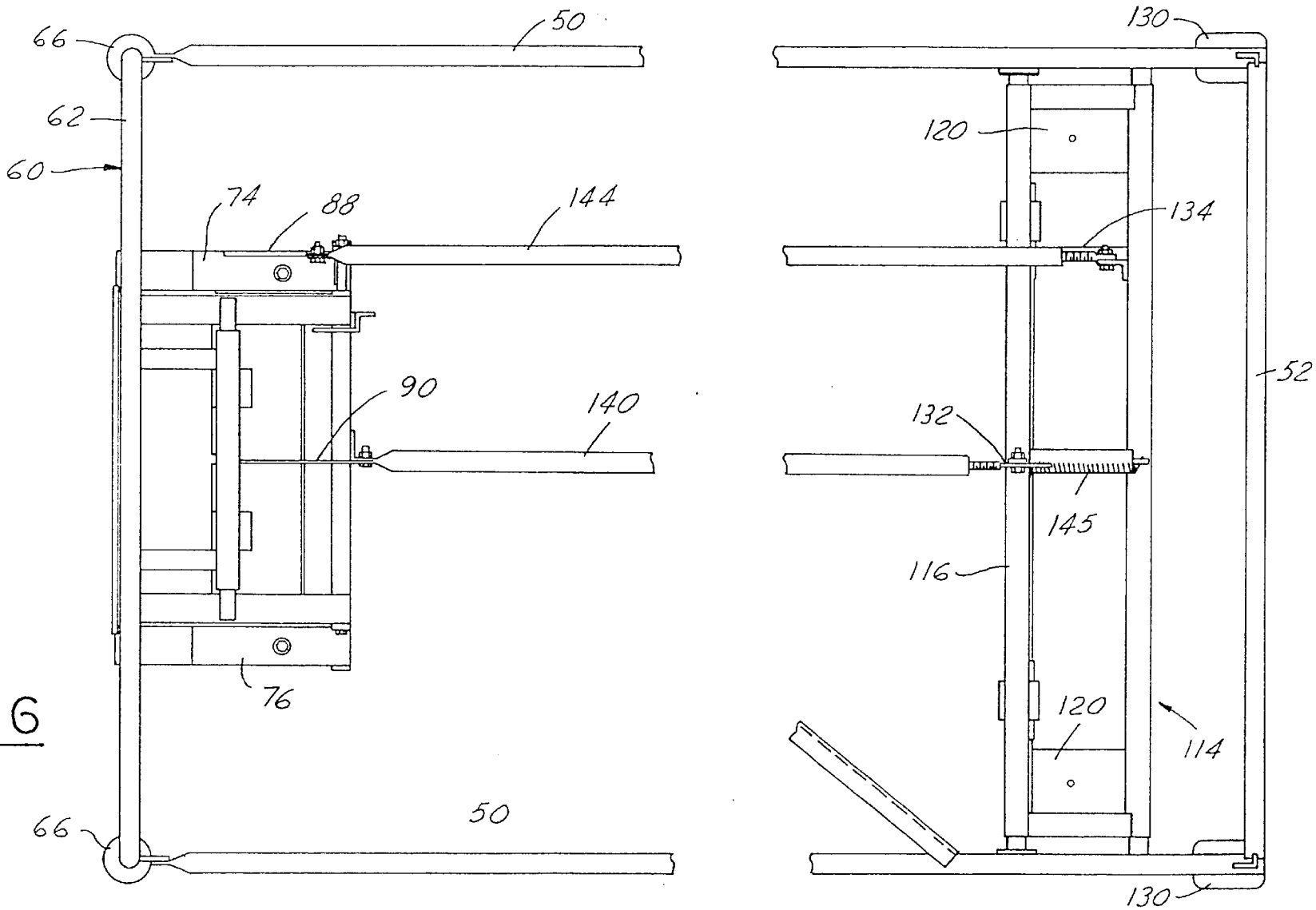
FIG. 6 is a top view of the base of the ladder stand with parts broken away in order to show the construction of the front and rear wheel supports.
Figure 7:
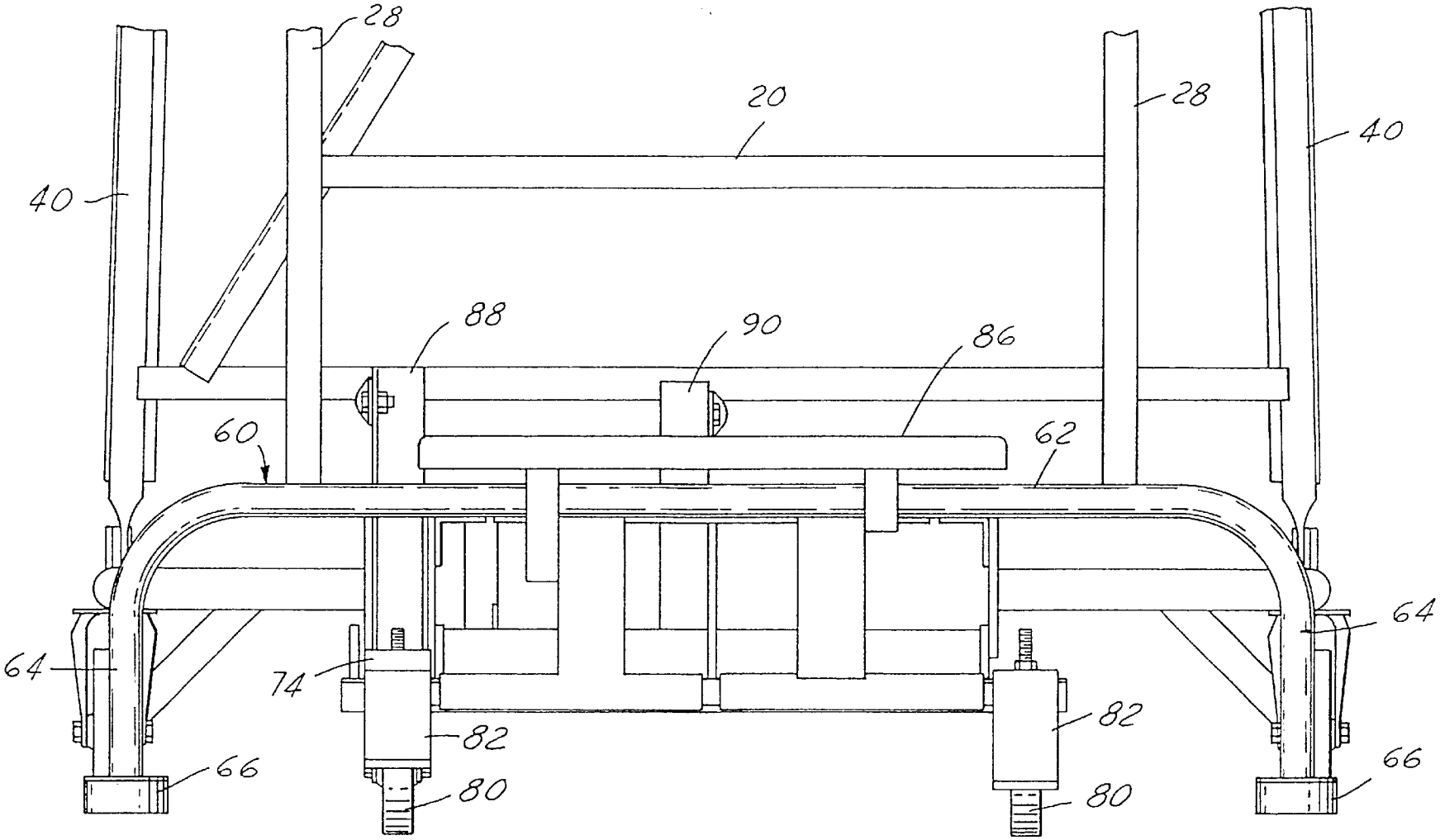
FIG. 7 is a fragmentary front elevational view of the ladder stand showing the front wheels in contact with the ground and the foot pads in an elevated position.

The rear wheel support 114 is provided with a pair of rear brackets or linkages 132 and 134. The rear linkage 132 is longitudinally aligned with front linkage 90, while the rear linkage 134 is longitudinally aligned with the front linkage 88 as illustrated in FIG. 6. A trip tube 140 is connected on one end to the front bracket or linkage 90 and on the other end to the rear bracket or linkage 132. A reset tube 144 is connected on one end to the front linkage 88 and on the other end to the rear linkage 134 as shown in FIG. 6. A spring 145 is carried by the rear wheel support 114 to assist in the resetting of the trip tube 140.

Prior to installing the trip tube 140 and the reset tube 144, it is advisable to place the ladder stand in an upright position. The first step is to reset the front and rear caster wheel assemblies 80 and 122 so that the ladder stand 10 is able to roll on the four swivable casters or wheels. The next step is to connect the trip tube 140 to the linkages 90 and 132. The trip tube has an eye bolt end which is connected to the rear linkage 132 while the crimped end is connected to the front linkage 90. It is necessary to tighten the bolts which connect the ends of the trip tube to the linkages. The bolts, when tightened, must still allow for the front and rear linkages to rotate.

The reset tube 144 is longer then the trip tube 140 although the tubes could be of the same length. The third step requires the eye bolt end of the reset tube 144 to be connected to the rear linkage 134 while the crimped end is connected to the front linkage 88. When attaching the reset tube 144 to the rear linkage 134, it is important that the eye bolt on the reset tube 144 and the lock nut are both on the outside of the rear linkage 134 as shown in FIG. 6. Thereafter the bolts are tightened sufficiently to permit both the front and rear linkages to rotate.

In operation, a person steps on the trip bar 86 which causes the ladder to drop onto the bumpers or pads 66 located in the front of the ladder stand 10 and onto the rigid casters or wheels 128 located at the rear of the stand. To reset the front of the ladder to roll on the swivel casters or wheels 80, it is necessary to step on the right pedal 94. To reset the rear of the ladder 10 to roll on the swivel casters or wheels 122, it is necessary to step down on the left pedal 92.

The ladder stand 10 provides stability when climbing and advances the mobility thereof when moving. The ladder stand 10 has three modes of operation. The first mode is when a person steps on the trip bar 86 which is located along the front edge of the bottom step 22. As a result thereof, the ladder stand 10 comes to rest on the front pads 66 and the rigid caster wheels 128 located in the rear. The rigid caster wheels 128 are in position to prevent movement of the ladder. This mode of operation is intended for climbing the ladder stand 10.

The second mode of operation occurs by stepping on the right pedal 94 located near the floor in the front of the ladder stand 10. At that time, the front legs 64 and the corresponding pads 66 are lifted from the floor. The swivel casters 80 located in the front and the rigid casters 128 located in the rear of the ladder stand 10 support the ladder. This allows or permits a person to push the ladder stand 10 to a new location. Such operation is beneficial when pushing the ladder stand 10 over relatively long distances. When rolling, the rigid casters or wheels 128 keep the tracking of the ladder straight. A ladder supported by four swivel casters, as in the prior art, tend to turn and drift off course, forcing the user to overcome this tendency. In mode number 2, the ladder stand 10 may only be pushed forward, backward or diagonally with straight tracking of the wheels. The turning radius is equal to the base length of the ladder stand. The first and second modes of operation just described are standard methods of operation in many conventional rolling ladders or ladder stands.

The third mode of operation distinguishes the present invention from the prior art. Once the ladder stand is in the second mode of operation, stepping on the left pedal 92 located near the floor near the front of the ladder stand 10 lifts the rear rigid caster wheels 128 from the floor. The swivable caster wheels 80 at the front and the swivable caster wheels 122 at the rear support the ladder stand 10. This permits the ladder stand 10 to be pushed to a new location. The third mode of operation is beneficial when pushing or turning the ladder stand in confined spaces. The use of the four swivable caster wheels and 80 and 122 allow for forward, backward, diagonal and lateral movements. The turning radius is reduced to one half of the base length of the ladder stand 10. The third mode of operation is new and unique to relatively large ladder stands.

PRIOR ART (FIG. 8)

Figure 8:
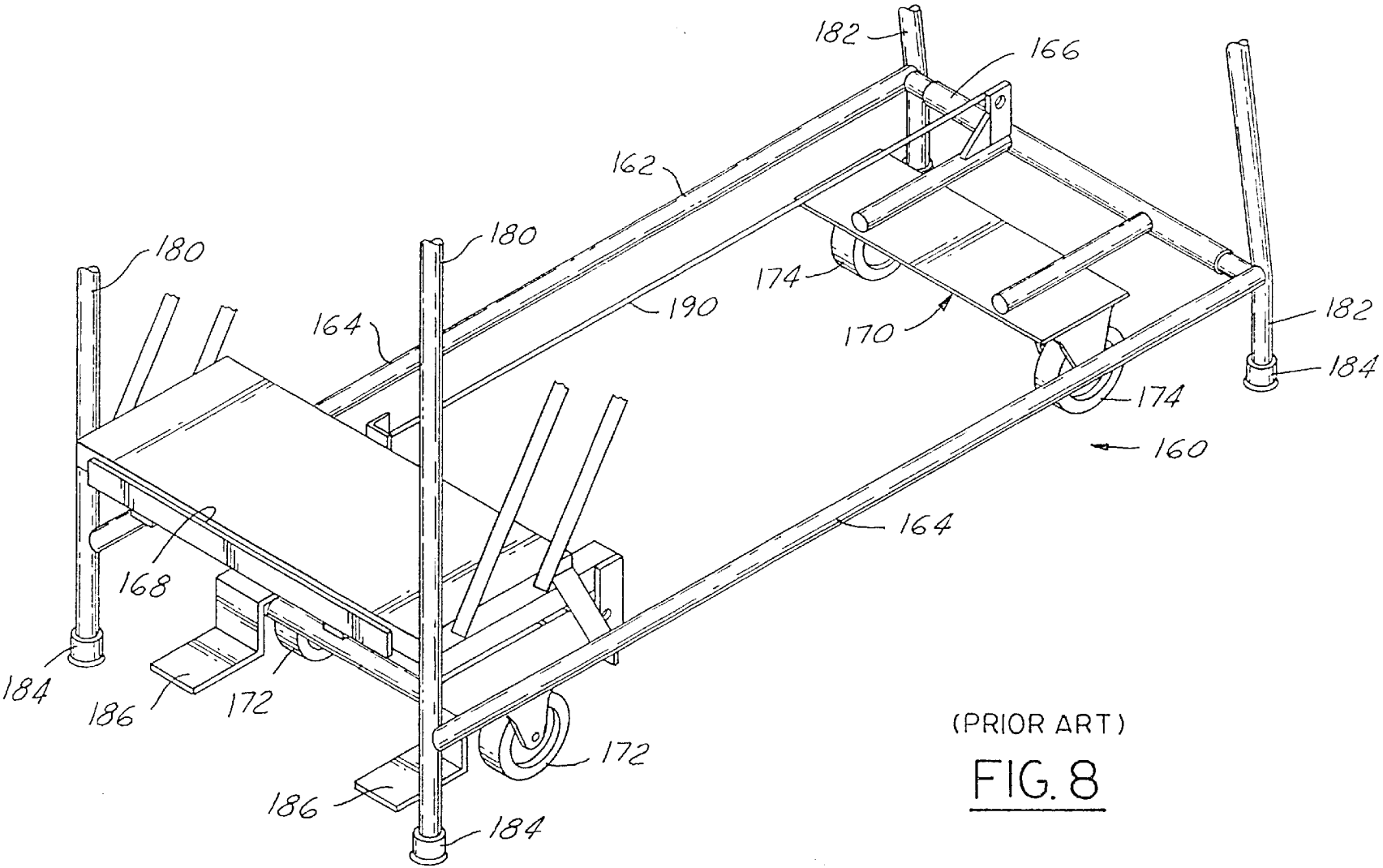
(PRIOR ART) FIG. 8
FIG. 8 is a perspective view of a prior art ladder stand employing a frame with front and rear wheel supports, each wheel support containing a pair of swivable caster wheels.

One of the prior art ladder stands made and sold for many years by the assignee of record is partially illustrated in FIG. 8. The ladder stand 160 has a rectangular base 162 including a pair of tubular longitudinally extending member 164 connected by a cross member 166 at the rear end thereof. A front wheel support 168 and a rear wheel support 170 are movably carried by the base 162. The front wheel support 168 is provided with a pair of conventional swivable casters or wheels 172 while the rear wheels support 170 is provided with a pair of swivable casters or wheels 174. The ladder stand 160 has a super structure above the base 160, not shown, including the front vertical legs 180 and the rear vertical legs 182. Each of the legs 180, 182 are provided with foot pads or bumpers 184. The pedals 186 are provided for raising and lowering the front casters or wheels 172, and the connecting rod 190 is used to raise and lower the rear casters or wheels 174. The rear mounted swivel casters or wheels 174 allow the ladder stand, as an example, with five to eight steps, to be more readily maneuverable in confined spaces. When climbing the ladder stand 160, the wheels are raised and the stand rests on the leg bumpers 184.

While there have been described above the principals of this invention in connection with a specific apparatus, it is to be clearly understood that this description is made only by way of example and not as a limitation to the scope of the invention.

What I claim is:

1. A ladder stand comprising:

a unitary base having a front end and a rear end;

a plurality of stair treads extending upwardly from said base and supported thereon;

a front wheel support mounted on and located proximate to the front end of said base;

a retractable first pair of swivable caster wheels mounted on said front wheel support;

a rear wheel support mounted on and located inwardly from the rear end of said base;

a retractable second pair of swivable caster wheels mounted on said rear wheel support;

a third pair of rigid caster wheels that are non-swivable mounted on the rear end of said base outwardly from said retractable second pair of swivable caster wheels;

a plurality of foot pads mounted on the front end of said base forward of said retractable first pair of swivable caster wheels;

a pair of laterally spaced-apart independently operated foot pedals mounted on said base at the front end thereof;

front and rear linkages respectively carried by said front and rear wheel supports;

a trip bar located at the front edge of the bottom stair tread;

a trip tube connected on one end to said front linkage and the other end to said rear linkage;

a reset tube connected on one end to said front linkage and on the other end to said rear linkage;

said trip bar, when actuated, causing said trip tube to raise said front and rear wheel supports and the corresponding first and second pairs of swivable caster wheels from the ground thereby permitting said base to drop onto said foot pads at the front end and onto said rigid caster wheels at the rear end thereby placing the ladder stand in a first mode of operation intended for climbing the ladder;

one of said pedals, when actuated, causing said reset tube to lower said front wheel support and bring said first pair of swivable caster wheels into contact with the ground thereby raising the front end of said base and the foot pads off the ground while maintaining said rigid caster wheels on the ground thereby placing the ladder stand in a second mode of operation intended for the ladder stand to be pushed to a new location either forward, backward or diagonally with straight tracking of said wheels; and the other of said pedals, when actuated, lowering said rear wheel support and bringing said second pair of swivable caster wheels into contact with the ground thereby raising said third pair of rigid caster wheels off the ground while maintaining said front caster wheels in contact with the ground thereby providing a third mode of operation intended for the ladder stand to be pushed or turned in confined spaces, with the four swivel caster wheels allowing for forward, backward, diagonal and lateral movement.

2. The ladder stand of claim 1, wherein, when facing the front end thereof, said one pedal is the right pedal which is actuated to reset the front of the ladder to roll on said first pair of swivel caster wheels.

3. The ladder stand of claim 1, wherein, when facing the front end thereof, said other pedal is the left pedal which is actuated to reset the rear of the ladder to roll on said second pair of swivel caster wheels.

4. The ladder stand of claim 3, wherein said reset tube is connected to said left pedal.

5. The ladder stand of claim 4, wherein said reset tube is longer than said trip tube.

6. The ladder stand of claim 4, wherein said reset tube and said trip tube are of the same length.

7. The ladder stand of claim 1, wherein the ladder when in said second mode of operation, has a turning radius equal to the base length of the ladder.

8. The ladder stand of claim 3, wherein the ladder when in said third mode of operation, has a turning radius equal to one-half of the base length of the ladder.

9. The ladder stand of claim 1, wherein said front and rear wheel support are resiliently biased to assist in returning said swivable first and second caster wheels in either said second or third modes of operation.

10. The ladder stand of claim 9, wherein means for resiliency are in the form of springs which are respectively interconnected between said base and one of said front and rear wheel supports.

11. The ladder stand of claim 1, wherein there are a pair of said foot pads.

* * * * *